US010697158B2

(12) United States Patent
Kopp

(10) Patent No.: US 10,697,158 B2
(45) Date of Patent: Jun. 30, 2020

(54) FAUCET CONTROL AID APPARATUS

(71) Applicant: David Kopp, Cincinnati, OH (US)

(72) Inventor: David Kopp, Cincinnati, OH (US)

(73) Assignee: David Kopp, Cincinnati, OH (US)

( * ) Notice: Subject to any disclaimer, the term of this patent is extended or adjusted under 35 U.S.C. 154(b) by 88 days.

(21) Appl. No.: 15/835,430

(22) Filed: Dec. 7, 2017

(65) Prior Publication Data

US 2018/0155907 A1 Jun. 7, 2018

Related U.S. Application Data

(60) Provisional application No. 62/430,984, filed on Dec. 7, 2016.

(51) Int. Cl.
*E03C 1/04* (2006.01)

(52) U.S. Cl.
CPC ..... *E03C 1/0412* (2013.01)

(58) Field of Classification Search
CPC ..... E03C 1/0412; E03C 1/04; E05B 1/0015; E05B 1/0053; E05B 53/001; A01B 1/026; A47B 95/02
USPC ..... 16/419, 420, 426, 444, 446
See application file for complete search history.

(56) References Cited

U.S. PATENT DOCUMENTS 209,573 A * 11/1878 Matthews ..... E05B 1/0015 16/412
1,529,835 A * 3/1925 Hamilton ..... B25G 3/02 16/446
4,266,320 A * 5/1981 Grant ..... E03B 9/02 16/427
4,783,883 A * 11/1988 Szalay ..... B25G 1/002 16/412
6,578,231 B1 * 6/2003 Godshaw ..... A45F 5/10 16/114.1
6,865,777 B2 * 3/2005 Comstock ..... A45C 13/262 16/114.1
6,868,581 B2 * 3/2005 Browder ..... B60D 1/00 16/110.1
D704,309 S * 5/2014 Lee ..... D21/608
2010/0175225 A1 * 7/2010 Sanchez Santos ..... A01B 1/00 16/426
2013/0283962 A1 * 10/2013 Lee ..... G05G 1/06 74/523
2014/0020210 A1 * 1/2014 Brennenstuhl ..... B25F 5/026 16/426

* cited by examiner

*Primary Examiner* — Roberta S Delisle
(74) *Attorney, Agent, or Firm* — The Watson IP Group, PLC; Jovan N. Jovanovic

(57) ABSTRACT

A faucet control apparatus having a handle, a ring member and optionally protrusions. The handle has a proximal and a distal end. The ring member is positioned proximate the proximal end thereof. The ring member has an inner perimeter which defines an opening. The protrusions include one or more outer protrusions optionally extending from the ring member spaced apart from the handle member.

17 Claims, 3 Drawing Sheets

FAUCET CONTROL AID APPARATUS

CROSS-REFERENCE TO RELATED APPLICATION

This application claims priority from U.S. Pat. App. Ser. No. 62/430,984 filed Dec. 7, 2016, entitled "Faucet Control Aid Apparatus", the entire disclosure of which is hereby incorporated by reference in its entirety.

BACKGROUND OF THE DISCLOSURE

1. Field of the Disclosure

The disclosure relates in general to an aid to manipulate a faucet or other device, and more particularly, to an aid useful for children to operate a faucet or other device where the child lacks the necessary size to reach the faucet controls, but can otherwise operate such a device. The disclosure is not limited to use with a faucet.

2. Background Art

For many children, it is not difficult to operate a faucet. The principles of the valves and the different temperature water controls are understood by a relatively young child. However, many times that child does not have the size to easily reach and manipulate the handles of a faucet.

There are varying results in such an instance. First, the child can ask a parent or other adult (or larger child) to assist. Unfortunately, this is often seen by the helper to be a nuisance. In other instances, the child can climb, reach or otherwise attempt to grasp the handles. While it may be successful sometimes, it is often the case that injury ensues when this is attempted.

SUMMARY OF THE DISCLOSURE

The disclosure is directed to a faucet control aid apparatus which is configured for use by children (although not limited to use by children) to reach and manipulate handles and other structures of a faucet (although the use thereof is not limited to use with a faucet)

In the configuration shown, the faucet control apparatus includes a handle that has a ring member at an end thereof. The ring member has an inner perimeter which defines an opening. One or more outer protrusions may extend from the ring member spaced apart from the handle member.

In one aspect of the disclosure, the disclosure is directed to a faucet control apparatus comprising a handle and a ring member. The handle has a proximal and a distal end. The ring member is positioned proximate the proximal end of handle. The ring member has an inner perimeter which defines an opening.

In some configurations, the faucet control apparatus includes one or more outer protrusions extending from the ring member spaced apart from the handle member.

In some configurations, the one or more protrusions further comprise a first side and a second side protrusion. The first side protrusion extends from the ring member spaced apart from the handle member. The second side protrusion extends from the ring member spaced apart from the handle member and from the first side protrusion.

In some configurations, the first side protrusion comprises at least one of a first side ear protrusion and a first side horn.

In some configurations, the first side protrusion further comprises both a first side ear protrusion and a first side horn.

In some configurations, the second side protrusion comprises at least one of a second side ear protrusion and a second side horn.

In some configurations, the second side protrusion comprises both of a second side ear protrusion and a second side horn.

In some configurations, the first side protrusion and the second side protrusions are mirror images of each other about an axis defined by the handle member.

In some configurations, the first side horn and the second side horn are spaced apart from each other.

In some configurations, the first side horn and the second side horn are curved to be directed away from the handle member.

In some configurations, the first ear and the second ear each include an upper surface and a lower surface defining a substantially planar member.

In some configurations, the first horn and the second horn have a substantially circular cross-sectional configuration.

In some configurations, the ring member is planar with the handle and wherein the body defines a substantially circular member.

In some configurations, the ring member has a substantially circular cross-sectional configuration.

In some configurations, the handle member comprises a frustoconical configuration having a larger cross sectional area proximate the distal end.

In some configurations, the handle, the body and the outer protrusions define a plane.

In some configurations, the apparatus is formed from a molded polymer.

In some configurations, the diameter of the distal end of the handle is greater than the diameter of the cross-sectional configuration of the ring member.

In another aspect of the disclosure, the disclosure is directed to a method of using a faucet control apparatus described herein.

BRIEF DESCRIPTION OF THE DRAWINGS

The disclosure will now be described with reference to the drawings wherein.

DETAILED DESCRIPTION OF THE DISCLOSURE

Figure 1:
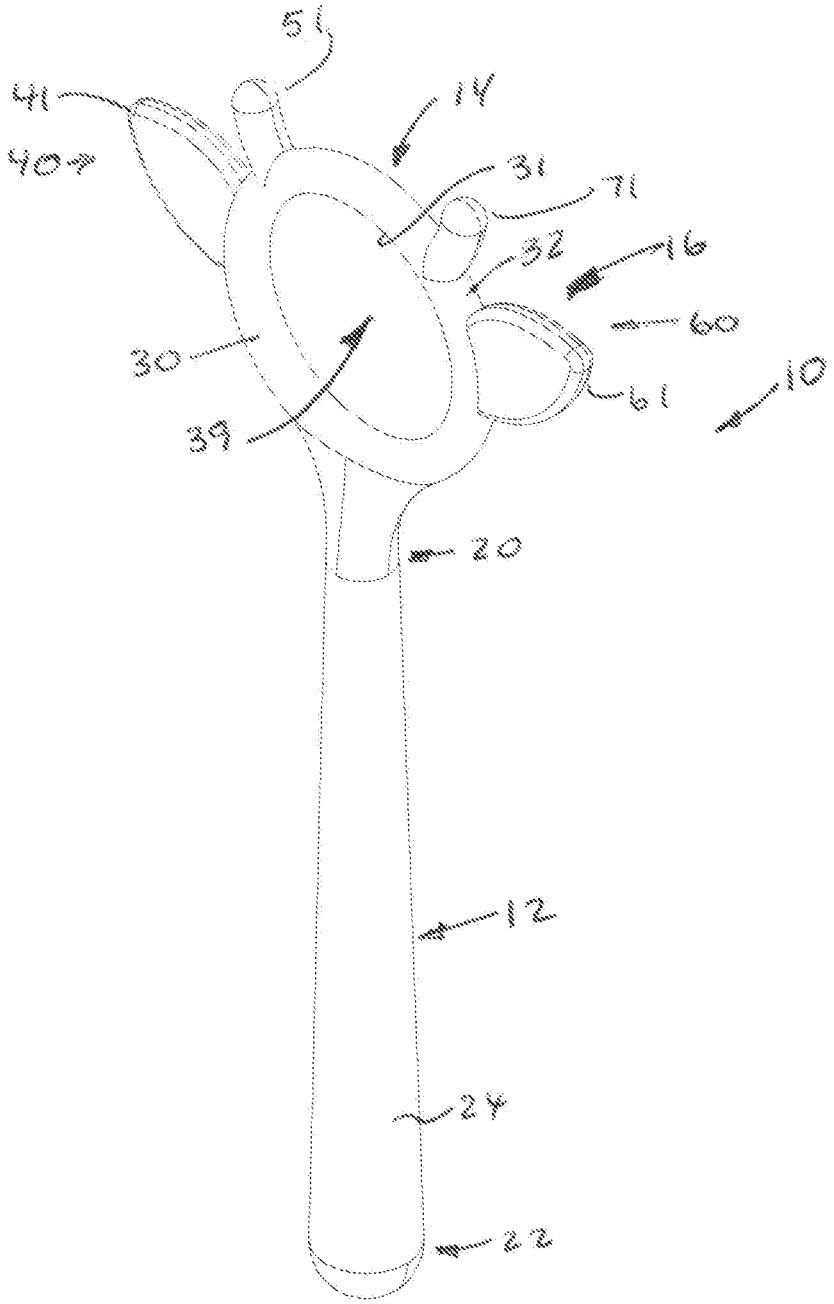
FIG. 1 of the drawings is a front, side, top perspective view of the faucet control aid apparatus.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the faucet control aid apparatus is shown generally at 10. The apparatus is particularly useful for children as an aid to reach the faucet handles. Typically, a young child may be of sufficient age to operate a faucet, however, the child lacks the height and size to reach the control handles of a faucet. In such a case, the child can through the aid of the faucet control aid apparatus reach the faucet control handles and manipulate them.

Figure 2:
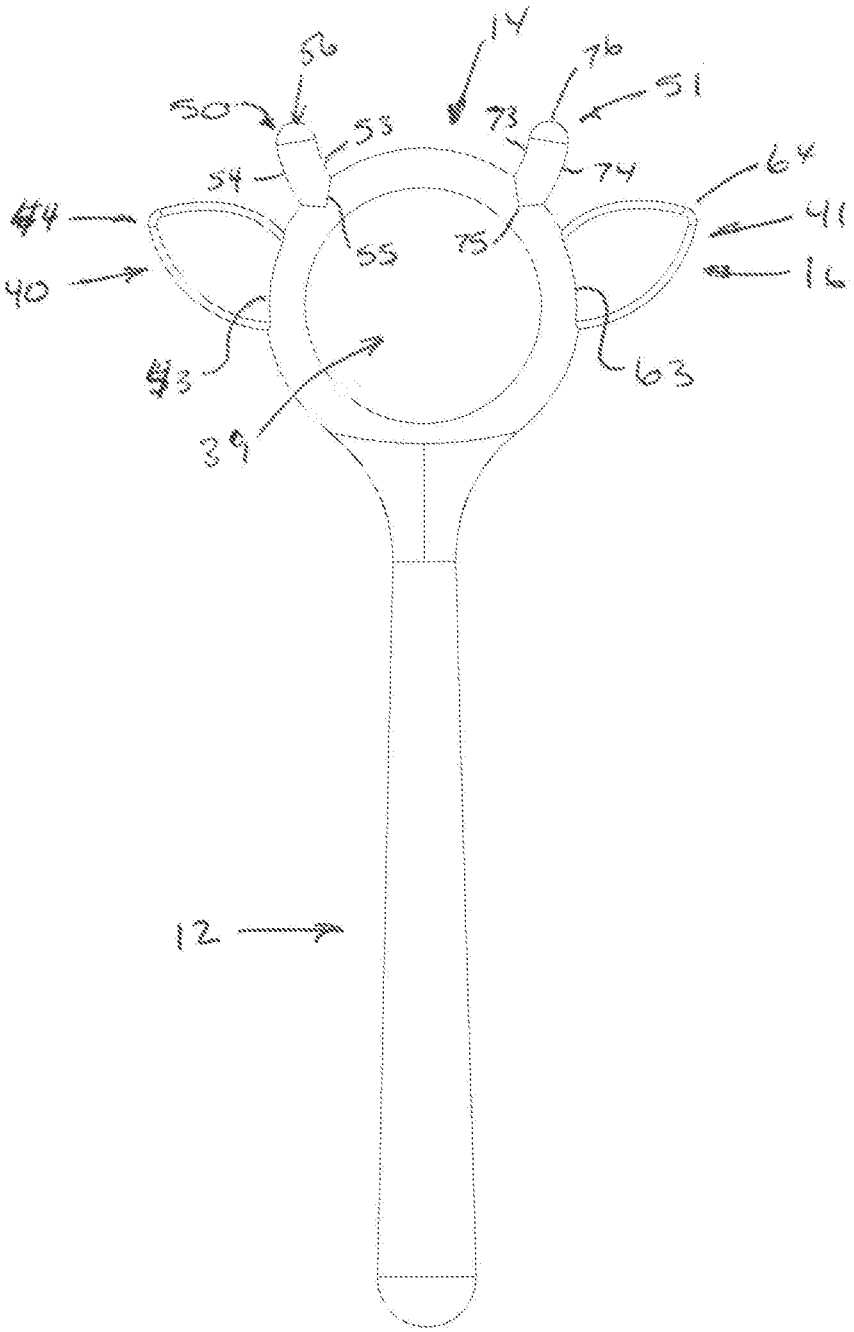
FIG. 2 of the drawings is a front elevational view of the faucet control apparatus.
Figure 3:
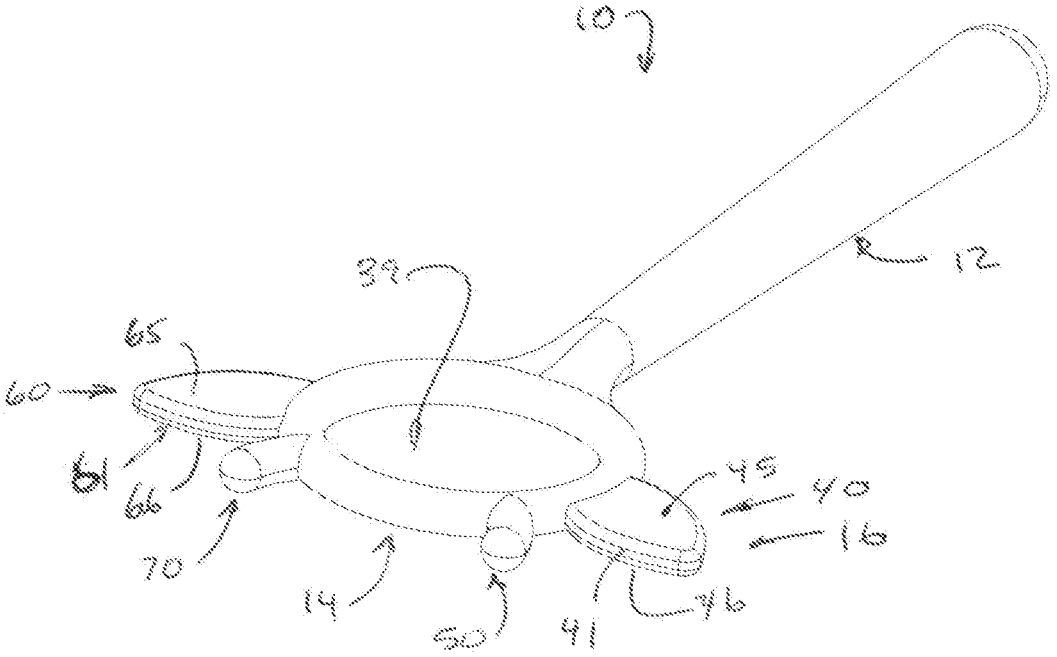
FIG. 3 of the drawings is a top, side, front perspective view of the faucet control aid apparatus.

More specifically, and with collective reference to FIGS. 1 through 3, the faucet control aid apparatus 10 includes handle 12, ring member 14 and outer protrusions 16. In the configuration shown, the underlying handle and ring member are molded form a nylon member, with a coating and the outer protrusions formed from an overmolded silicone material. Of course, in other configurations, other materials and methods of formation are contemplated. For example, in other configurations, the entire configuration may be molded from a single material. In still other configurations, the entire structure may be formed through other means, and from other materials, such as wood, metal or composites (as well as a combination of any of the foregoing).

The handle 12 includes proximal end 20 and distal end 22. With the proximal end extending into ring member 14. The handle 12, in the configuration shown, includes a rounded distal end (that is hemispherical in configuration). The handle member includes an outer surface 24, which between the proximal and distal ends, comprises a frustoconical configuration, with a generally circular cross-sectional configuration. In other configurations, the handle member may include protrusions or other structures to aid in the grasping of the handle. In the configuration shown, the handle is on the order of 22 cm, however, longer and shorter handles are contemplated. The thickness of the handle is 1.5 cm at the proximal end and 2.5 cm at the distal end, with the thickness varying linearly therebetween. Of course, again, differing diameters are contemplated. It is further contemplated that an adjustable, or lengthening/shortening, feature may be supplied to the handle (i.e., a telescoping handle, or a folding handle, or the like).

The ring member 14, in the configuration shown includes body 30 having an inner perimeter 31 and an outer perimeter 32, the inner perimeter of which defines a generally circular opening 39. The ring member has a substantially circular cross-sectional configuration, and a thickness that is substantially uniform. The ring member is mounted at the proximal end of the handle 12, and the handle may include a fillet or other structure so as to smoothly transition from the handle to the ring member. It is contemplated that the handle member intersects the ring member perpendicular to a tangent at the point of connection so that the two are generally centered about an axis extending through the handle. In other configurations, the handle may be offset so as to intersect the ring member at an angle relative to a tangent at the point of intersection, or parallel (or collinear) to a tangent at the point of intersection. Additionally, it is contemplated that the ring member and the handle lie in the same plane.

The ring member, in the configuration shown, has a circular cross-sectional configuration that is 1 cm in diameter, and is generally uniform throughout. The diameter of the inner perimeter is 6 cm, with the diameter of the outer perimeter being 8 cm. Again, variations in these diameters as well as variations in the shape (i.e., circular, etc.) are contemplated, such as elliptical, oval, polygonal, or an arbitrary shape, among others. Additionally, the ring member is shown as being a continuous and complete circle, while it is contemplated that the ring member may be arcuate in configuration (i.e., not a continuous ring, but with a break, thereby defining two ends, for example).

The outer protrusions 16 extend outwardly from the ring member, generally opposite of the handle. In the configuration shown, first side protrusions 40 and second side protrusions 60 are presented. If the ring member is considered to be like a clock, with the handle member positioned proximate 6 o'clock, the first side protrusions extend between 10 and 12 o'clock with the second side protrusions extending between 12 and 2 o'clock. In some configurations, a single protrusion may be presented, or a pair of protrusions, preferably on a first side and a second side, as is shown (i.e., on opposing sides of the axis defining the handle).

The first side protrusions 40 include first ear 41 and first horn 51. The configuration shown mimics the features of a giraffe (i.e., ears and horns), while it is contemplated that other configurations that mimic nature or that do not mimic nature may be utilized. The first ear 41 extends from the ring member and includes proximal end 43 and distal end 44. The first ear is substantially planar, and defines upper surface 45 and lower surface 46. The outer perimeter includes a first arc and a second arc that meet at the distal end.

The first horn 51 is positioned on the other side of the first ear from the handle, and includes inner surface 53, outer surface 54 and extends from proximal end 55 to distal end 56. In the configuration shown, the inner and outer surfaces comprise arcuate formations that are substantially parallel to each other and spaced apart so as to have a substantially even thickness. The first horn may comprise a cross-sectional configuration that is substantially circular, although variations are contemplated.

It will be understood that the second side protrusions 60 include first ear 61 and second horn 51. The second side protrusions are similar to the first side protrusions and are substantial mirror images of the first side protrusions taken about an axis defined by the handle. As such, the same structures on the second side protrusion are identified with the same reference number augmented by 20. That is, the first ear is reference number 41 and the second ear has a reference number augmented by 20, or 61. The same numbering structure is utilized for the different components of the second side protrusion 60. Interestingly, the different handle ring member and outer protrusions generally define a faucet control apparatus plane.

In operation, the user (typically a child) can grasp the handle about the outer surface 24 thereof generally between the proximal and distal end (although the user's hand may extend beyond the distal end. The user can then reach over a sink to the handle of a faucet. Generally, the length of the handle is sufficient for a user that can reach the faucet and the stream from the faucet, but not generally reach the handle or the entire range of the movement of the handle.

The user can manipulate the faucet handle in many different motions. For example, the user can place the handle within the ring member and extend the handle through the opening 39 of the ring member. The user can then manipulate the faucet control aid apparatus 10 to achieve the desired motion of the handle of the faucet. The faucet handle can be turned on, off or redirected while extending through the opening of the ring member.

In other configurations, the user can push or pull the handle of the faucet with the outer protrusions. That is, the protrusions can be utilized to contact, push and pull the handle of the faucet. Further, the outer protrusions in combination with the ring member can be used to manipulate the handle of the faucet. It will be understood that the curved nature of the first and second horn facilitate the reaching and retaining of the handle of the faucet and the directing of the handle of the faucet into a region bound by the horn and the ring member.

Once the user is done using the faucet control aid apparatus, the apparatus can be easily disengaged from the handle of the faucet and placed on the counter surface surrounding the sink or bowl. In other configurations, a hook or other structure may be coupled to a vertical or vertically inclined surface. The hook can be extended through the ring member so as to allow the ring member to secure the apparatus to the hook. In still other configurations, a carrying case or the like can be provided or fashioned so as to facilitate handling and storage of the handle.

It will be understood that the faucet control aid apparatus can be utilized for more than just turning (and directing) the handle of the faucet. For example, the apparatus can be used to adjust the spout of the faucet (where the spout is adjustable or where the spout pivots or rotates about an axis). The apparatus can also be used to adjust a drain plug or a drain stopper. Additionally, the device has utility to reach and manipulate light switches that are also out of reach or other structures that are out of reach for a child (where the child is otherwise able to operate such a structure or device).

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A faucet control apparatus comprising:

a handle having a proximal and a distal end, the proximal end engageable with a sink handle of a faucet with the distal end being graspable by a user and spaced apart from the sink handle when in use;

a ring member positioned proximate the proximal end thereof, the ring member has a body the has an inner perimeter which defines an opening, wherein the ring member is planar with the handle and wherein the body defines a substantially circular member, wherein, in use, the ring member is engageable with the sink handle of a faucet.

2. The faucet control apparatus of claim 1 further comprising:

one or more outer protrusions extending from the ring member spaced apart from the handle member.

3. The faucet control apparatus of claim 2 wherein the one or more protrusions further comprise:

a first side protrusion extending from the ring member spaced apart from the handle member;

a second side protrusion extending from the ring member spaced apart from the handle member and from the first side protrusion.

4. The faucet control apparatus of claim 3 wherein the first side protrusion comprises at least one of a first side ear protrusion and a first side horn.

5. The faucet control apparatus of claim 4 wherein the first side protrusion further comprises both a first side ear protrusion and a first side horn.

6. The faucet control apparatus of claim 4 wherein the second side protrusion comprises at least one of a second side ear protrusion and a second side horn.

7. The faucet control apparatus of claim 6 wherein the second side protrusion comprises both of a second side ear protrusion and a second side horn.

8. The faucet control apparatus of claim 6 wherein the first side protrusion and the second side protrusions are mirror images of each other about an axis defined by the handle member.

9. The faucet control apparatus of claim 8 wherein the first side horn and the second side horn are spaced apart from each other.

10. The faucet control apparatus of claim 9 wherein the first side horn and the second side horn are curved to be directed away from the handle member.

11. The faucet control apparatus of claim 6 wherein the first ear and the second ear each include an upper surface and a lower surface defining a substantially planar member.

12. The faucet control apparatus of claim 11 wherein the first horn and the second horn have a substantially circular cross-sectional configuration.

13. The faucet control apparatus of claim 1 wherein the ring member has a substantially circular cross-sectional configuration.

14. The faucet control apparatus of claim 13 wherein the handle member comprises a frustoconical configuration having a larger cross sectional area proximate the distal end.

15. The faucet control apparatus of claim 1 wherein the apparatus is formed from a molded polymer.

16. The faucet control apparatus of claim 1 wherein the diameter of the distal end of the handle is greater than the diameter of the cross-sectional configuration of the ring member.

17. A method of using a faucet control apparatus of claim 1, comprising the steps of:

providing the faucet control apparatus;

grasping the handle member near the distal end thereof;

directly engaging a portion of a handle of a faucet with the ring member;

altering the position of the handle of the faucet with the ring member; and releasing the ring member from engagement with the handle of the faucet.

* * * * *